US009898997B2

(12) United States Patent
Baek et al.

(10) Patent No.: US 9,898,997 B2
(45) Date of Patent: Feb. 20, 2018

(54) DISPLAY DRIVING CIRCUIT

(71) Applicant: Samsung Electronics Co., Ltd., Suwon-Si, Gyeonggi-Do (KR)

(72) Inventors: Dong-Hoon Baek, Seoul (KR); Jae-Yoon Sim, Pohang-si (KR); Dong-Myung Lee, Yongin-si (KR); Jae-Youl Lee, Hwaseong-si (KR)

(73) Assignees: Samsung Electronics Co., Ltd., Gyeonggi-do (KR); Postech Academia-Industry Collaboration Foundation, Gyeongsangbuk-do (KR)

( * ) Notice: Subject to any disclaimer, the term of this patent is extended or adjusted under 35 U.S.C. 154(b) by 332 days.

(21) Appl. No.: 14/606,282

(22) Filed: Jan. 27, 2015

(65) Prior Publication Data

US 2015/0213779 A1 Jul. 30, 2015

Related U.S. Application Data

(60) Provisional application No. 61/931,765, filed on Jan. 27, 2014.

(30) Foreign Application Priority Data

Nov. 13, 2014 (KR) ..... 10-2014-0158279

(51) Int. Cl.
*G09G 5/00* (2006.01)

(52) U.S. Cl.
CPC ..... *G09G 5/008* (2013.01); *G09G 2310/0297* (2013.01); *G09G 2310/08* (2013.01); *G09G 2330/06* (2013.01)

(58) Field of Classification Search
CPC ..... G09G 5/008; G09G 2330/06; G09G 2330/08; G09G 2330/0297
See application file for complete search history.

(56) References Cited

U.S. PATENT DOCUMENTS 7,826,583 B2 11/2010 Jeong et al.
7,974,375 B2 7/2011 Kim et al.
(Continued)

FOREIGN PATENT DOCUMENTS

KR 100653159 B1 11/2006
KR 100834393 B1 6/2008
(Continued)

*Primary Examiner* — Ariel Balaoing
(74) *Attorney, Agent, or Firm* — Harness, Dickey & Pierce, P.L.C.

(57) ABSTRACT

The display driving circuit including a type detector for receiving a data packet including a 2-bit embedded signal, in which a clock signal embedded in a data signal, and outputting a first reference clock or a second reference clock different from the first reference clock according to a type of the data packet, a window generator for receiving multiphase clocks and providing to the type detector a first window reference and a second window reference different from the first window reference to be used in determining the type of the data packet, a buffer for delaying the first reference clock by a first interval and delaying the second reference clock by a second interval different from the first interval, and a multiplexer for multiplexing the delayed first and second reference clocks and outputting a multiplexed reference clock may be provided.

15 Claims, 12 Drawing Sheets

(56) References Cited

U.S. PATENT DOCUMENTS

| | | | | |
|---|---|---|---|---|
| 7,995,693 | B2 | 8/2011 | Lee | |
| 8,237,699 | B2 | 8/2012 | Hong et al. | |
| 8,279,216 | B2 | 10/2012 | Hong et al. | |
| 8,442,178 | B2 | 5/2013 | Kim et al. | |
| 8,559,531 | B2 | 10/2013 | Lee | |
| 8,878,792 | B2 | 11/2014 | Lim et al. | |
| 8,884,934 | B2 | 11/2014 | Jeon et al. | |
| 2005/0093597 | A1* | 5/2005 | Kwak | H03L 7/0812 327/158 |
| 2008/0246752 | A1* | 10/2008 | Lee | G09G 3/20 345/213 |
| 2009/0051675 | A1 | 2/2009 | Huang | |
| 2011/0037758 | A1* | 2/2011 | Lim | H03L 7/0805 345/213 |
| 2011/0181558 | A1* | 7/2011 | Jeon | G09G 3/3611 345/204 |
| 2012/0206429 | A1 | 8/2012 | Lee et al. | |
| 2014/0334583 | A1 | 11/2014 | Lee | |

FOREIGN PATENT DOCUMENTS

| | | | |
|---|---|---|---|
| KR | 100975083 | B1 | 8/2010 |
| KR | 2011-0021386 | A | 3/2011 |
| KR | 101125504 | B1 | 3/2012 |
| KR | 2012-0091858 | A | 8/2012 |
| KR | 101174768 | B1 | 8/2012 |
| KR | 101190091 | B1 | 10/2012 |
| KR | 101266067 | B1 | 5/2013 |
| KR | 101301698 | B1 | 8/2013 |

* cited by examiner

DISPLAY DRIVING CIRCUIT

CROSS-REFERENCE TO RELATED APPLICATION

This application claims priority from U.S. provisional application No. 61/931,765 filed on Jan. 27, 2014 in the USPTO and Korean Patent Application No 10-2014-0158279 filed on Nov. 13, 2014 in the Korean Intellectual Property Office, and all the benefits accruing therefrom under 35 U.S.C. § 119, the contents of which in its entirety are herein incorporated by reference

BACKGROUND

1. Field

The present inventive concepts relate to display driving circuits.

2. Discussion of the Related Art

A display device may include a signal controller, a gate driver, a data driver and a display panel. The signal controller may provide a gate control signal to the gate driver and may provide a video data signal and a data control signal to the data driver. Each of the gate driver and the data driver may include a plurality of driving chips.

Each gate driving chip may provide a gate signal to each gate line, each gate driving chip may provide a gate signal to each gate line and each data driving chip may provide a video data voltage corresponding to a video data signal to each data line.

Along with the recent tendency toward achieving high-resolution, deep-color display devices, an interface that can provides a video data signal and a data control signal in an efficient and stable manner between a signal controller and a data driving chip.

For example, in an intra-panel interface situation, demands for clock embedded signaling for transmitting data at a high speed without a clock line and clock data recovery (CDR) recovering clock and data using the clock embedded signaling are being increased.

Further, in data transmission, demands for methods of reducing electromagnetic interference (EMI), which refers to a phenomenon of disturbing operation of another electronic device caused by energy concentration of an electronic device on a particular frequency, are being increased.

SUMMARY

The present inventive concepts provide display driving circuits, which can reduce EMI and achieves highly efficient data transfer using clock embedded signaling.

The above and other objects of the present inventive concepts will be described in or be apparent from the following description of the example embodiments.

According to an example embodiment of the present inventive concepts, a display driving circuit includes a type detector configured to receive a data packet including a 2-bit embedded signal, in which a clock signal is embedded in a data signal, and output one of a first reference clock and a second reference clock different from the first reference clock according to a type of the data packet, a window generator configured to receive a multi-phase clocks and provide to the type detector a first window reference and second window reference different from the first window reference, the first and second window references to be used in determining the type of the data packet, a buffer configured to delay the first reference clock by a first interval and delay the second reference clock by a second interval different from the first interval, and a multiplexer configured to multiplex the delayed first and second reference clocks and output a multiplexed reference clock.

According to another example embodiment of the present inventive concepts, a display driving circuit includes a clock recovery circuit configured to receive a data packet including a 2-bit embedded signal, in which a clock signal is embedded in a data signal, and generate a multiplexed reference clock having a rising edge at a middle place of a first bit of the data packet, a delay locked loop configured to receive the multiplexed reference clock and generate multi-phase clocks sequentially delayed by a unit interval, the unit interval corresponding to an interval of one bit, and a sampler configured to extract a plurality of data signals from the data packet using the multi-phase clocks and including a logic configured to extract a 1-bit data signal from the embedded signal.

According to still another example embodiment of the present inventive concepts, a display driving circuit includes when a reference bit of a data signal is a first value, a first converter forming a first type data packet including a 2-bit embedded signal without a transition, and when a reference bit of a data signal is a transitioned value of the first value, a second converter forming a second type data packet including a 2-bit embedded signal with a transition, wherein the embedded signal of the first type data packet includes a transition value of a signal appearing right after the embedded signal and the embedded signal of the second type data packet has a first bit that is the same with a signal appearing right before the embedded signal and a second bit that is a transitioned signal of the first bit.

According to yet another example embodiment of the present inventive concepts, a display driving circuit includes a clock recovery circuit configured to receive a data packet including an embedded signal and generate a multiplexed reference clock having a rising edge at a middle place of one bit of the data packet, the data packet including a reference bit, the reference bit having a value depending on a type of the data packet, a delay locked loop configured to receive the multiplexed reference clock and generate multi-phase clocks sequentially delayed by a unit interval, the unit interval corresponding to an interval of one bit, and a sampler configured to extract a plurality of data signals including an 1-bit data signal using the multi-phase clocks, the 1-bit data signal having a value of the reference bit.

BRIEF DESCRIPTION OF THE DRAWINGS

The above and other features and advantages of the present inventive concepts will become more apparent by describing in detail various example embodiments thereof with reference to the attached drawings in which.

DETAILED DESCRIPTION

Figure 1:
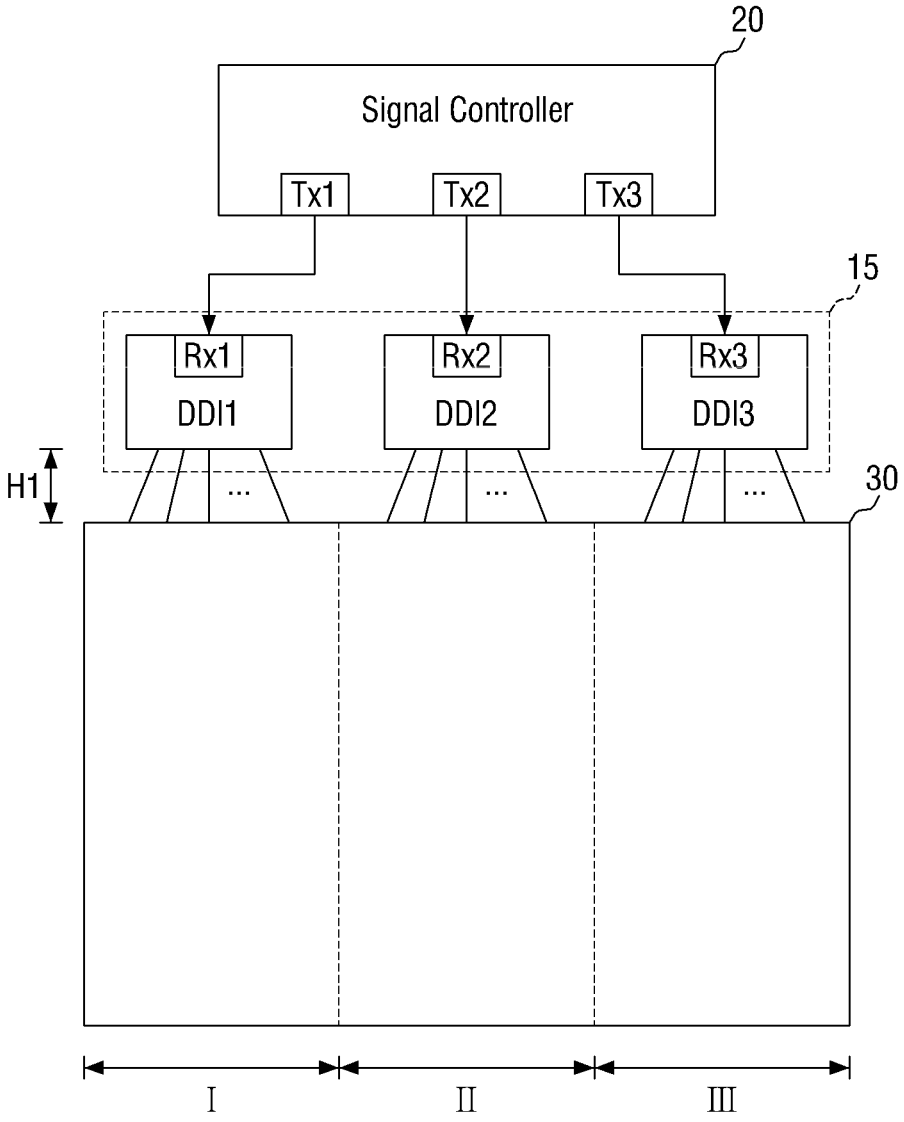
FIG. 1 is a block diagram of a display device according to an example embodiment of the present inventive concepts.

Advantages and features of the present inventive concepts and/or methods of accomplishing the same may be understood more readily by reference to the following detailed description of various example embodiments and the accompanying drawings. The present inventive concepts may, however, be embodied in many different forms and should not be construed as being limited to the example embodiments set forth herein. Rather, these example embodiments are provided so that this disclosure will be thorough and complete and will fully convey the inventive concepts to those skilled in the art. Like reference numerals refer to like elements throughout the specification.

The terminology used herein is for the purpose of describing particular example embodiments only and is not intended to be limiting of the inventive concepts. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which the present inventive concepts belong. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, a display driving circuit according to some example embodiments of the present inventive concepts will be described with reference to FIGS. 1 to 12.

FIG. 1 is a block diagram of a display device according to an example embodiment of the present inventive concepts.

For example, the display device may be an organic light emitting diode display (OLED), liquid crystal display (LCD), a plasma display panel (PDP), an electrochromic display (ECD), a digital mirror device (DMD), an actuated mirror device (AMD), a grating light value (GLV), a plasma display panel (PDP), or an electro luminescent display (ELD).

Further, the display devices according to example embodiments of the present inventive concepts may include a signal controller 20, a data driver 15, and a display panel 30.

The display panel 30 may be divided into a plurality of regions I, II and III. Although the display panel 30 having three divided regions I, II and III is illustrated in FIG. 1, the present inventive concepts are not limited thereto. The display panel 30 may be divided into three or more regions. Each of the plurality of display driving circuits may control the corresponding region of the display panel 30. Although not specifically shown, the display panel 30 may include a plurality of gate lines (not shown), a plurality of data lines (not shown) and a plurality of pixels (not shown).

The signal controller 20 may provide a data packet including a data signal, to which a clock signal is embedded, to the data driver 15. The signal controller 20 includes transmission terminals Tx1 to Tx3 to transmit the data packet. Although not specifically shown, the signal controller 20 may receive raw image signals and external control signals controlling display of the raw image signals and may output the data packet, in which the clock signal is embedded in the data signal.

For example, the data signal received by the signal controller 20 may include raw image signals RGB or image data signals converted from the raw image signals RGB. However, the present inventive concepts are not limited thereto.

The data driver 15 may include display driving integrated circuit (IC) (DDI), a source IC, or an LCD driving IC (LDI). For example, the data driver 15 may include a plurality of display driving ICs DDI1 to DDI3. The plurality of display driving ICs DDI1 to DDI3 includes receiving terminals Rx1 to Rx3 to receive the data packet. The plurality of display driving ICs DDI1 to DDI3 may extract the data signal from the data packet received from the signal controller 20. The clock signal embedded in the data packet may be used to extract the data signal by sampling the data packet at appropriate intervals. The extracted data signal may be transferred to the display panel 30.

The display panel 30 may be driven by the plurality of display driving ICs to reduce a size of the display device. For example, if the display panel 30 is controlled by a single display driving IC, a distance between the display driving ICs to some of the various regions of the display panel 30 may substantially increase. Accordingly, a space for a connection between a single display driving IC and all pixels of the display panel 30 (or data lines and gate lines connected to the pixels) may be substantially large. Thus, more than one display driving ICs (e.g., three display driving circuits DDI1 to DDI3) may be used to reduce a distance H1 or a space for the connection between each of the three display driving circuits DDI1 to DDI3 and the display panel 30.

Some example operations of the signal controller 20 and the data driver 15 will later be described in detail.

Figure 2:
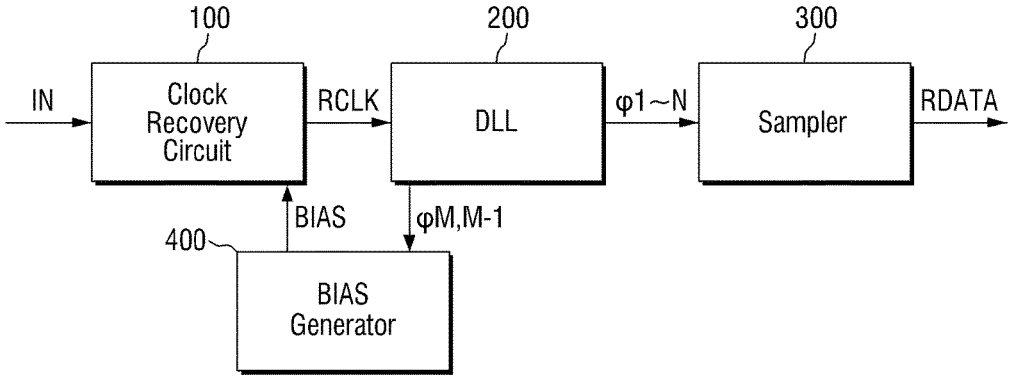
FIG. 2 is a block diagram of a display driving circuit according to an example embodiment of the present inventive concepts.

FIG. 2 is a block diagram of a display driving circuit according to an example embodiment of the present inventive concepts.

Referring to FIG. 2, the display driving circuit according to an example embodiment of the present inventive concepts may include a clock recovery circuit 100, a delay locked loop (DDL) 200, and a sampler 300.

The clock recovery circuit 100 may receive a data packet (IN) including a data signal having a 2-bit embedded signal, to which a clock signal is embedded, and may generate a multiplexed reference clock RCLK based on the clock signal embedded in the data packet. The clock recovery circuit 100 may receive two type data packets as input data. The clock recovery circuit 100 may extract the clock signal embedded in the data packet based on the two type data packets. The extracted clock signal may be the reference clock RCLK. The multiplexed reference clock RCLK may be provided to the delay locked loop 200.

A time period of the multiplexed reference clock RCLK may be equal to a length of the data packet. The multiplexed reference clock RCLK may have a rising edge at a middle place of a first bit of the data packet. However, the present inventive concepts are not limited thereto. The rising edge of the multiplexed reference clock RCLK may be at a middle place of another bit.

Detailed descriptions of functional components of the clock recovery circuit 100 will be provided later.

The delay locked loop 200 may receive the multiplexed reference clock RCLK from the clock recovery circuit 100 and generate multi-phase clocks $\phi 1$ to $\phi N$. The multi-phase clocks $\phi 1$ to $\phi N$ may be generated to be sequentially delayed by a unit interval UI corresponding to an interval of one bit on the basis of the reference clock RCLK. In the following description, it is assumed that the unit interval UI corresponds to an interval of 1-bit (hereinafter, unit interval).

The delayed locked loop 200 may generated the multi-phase clocks $\phi 1$ to $\phi N$ including N clock signals. For example, in a case that a data packet has 9 bits, the delay locked loop 200 may generate 9 multi-phase clocks $\phi 1$ to $\phi 9$, and each of the multi-phase clocks $\phi 1$ to $\phi 9$ may be sequentially delayed by a unit interval. The generated multi-phase clocks $\phi 1$ to $\phi 9$ may be used to sample data signal from the data packet. The N phase clocks $\phi 1$ to $\phi N$ may be transferred to the sampler 300. Some of the multi-phase clocks $\phi 1$ to $\phi N$ may be provided to the bias generator 400, which locks a bias such that a signal is delayed by half the unit interval UI (i.e., 0.5 times of the UI, hereinafter briefly referred to as 0.5 UI). Although not specifically shown, some of the multi-phase clocks $\phi 1$ to $\phi N$ may be fed back to the clock recovery circuit 100.

The sampler 300 may extract a plurality of data signals RDATA from the data packet using the multi-phase clocks $\phi 1$ to $\phi N$. The sampler 300 may include a logic extracting a data signal of 1-bit from the embedded signal included in the data packet. For example, the logic may include an exclusive OR gate. Further, the sampler 300 may extract the data signal of 1-bit from the embedded signal using Nth and (N+1)th signals of the multi-phase clocks $\phi 1$ to $\phi N$ and may output N data signals including the extracted data signals. Detailed explanation will be provided later.

The display driving circuit may further include a bias generator 400. The bias generator 400 may lock the bias BIAS to allow the delay buffer included in the clock recovery circuit 100 to delay the signal by 0.5 UI. Accordingly, the rising edge of the multiplexed reference clock RCLK may be generated at a middle place of a bit included in the data packet, rather than between two adjacent bits of the data packet. Thus, the multiplexed reference clock RCLK may be delayed by multiple times of 0.5 UI, which will later be described in detail.

Figure 3:
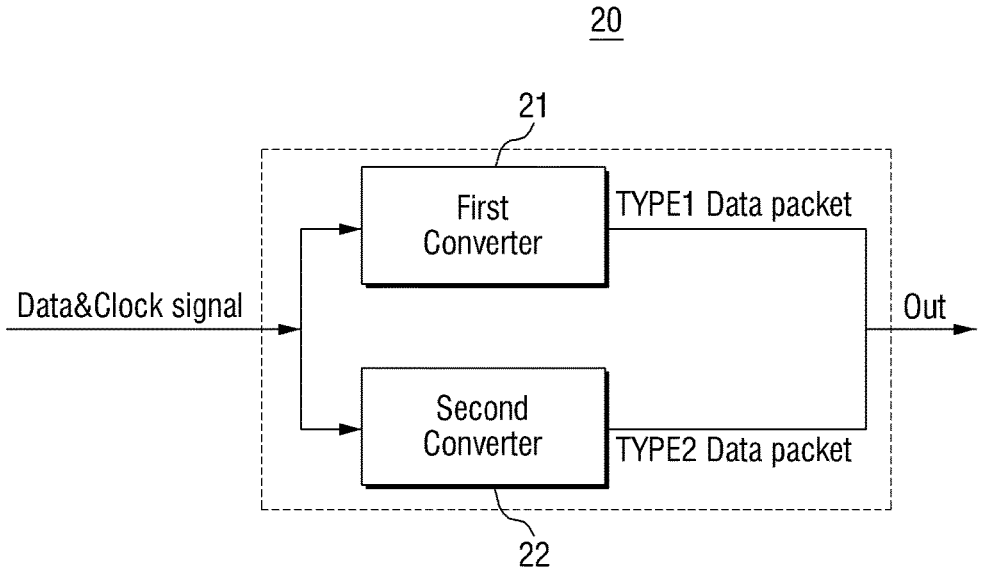
FIG. 3 is a block diagram of a signal controller of the display device according to an example embodiment of the present inventive concepts.
Figure 4:
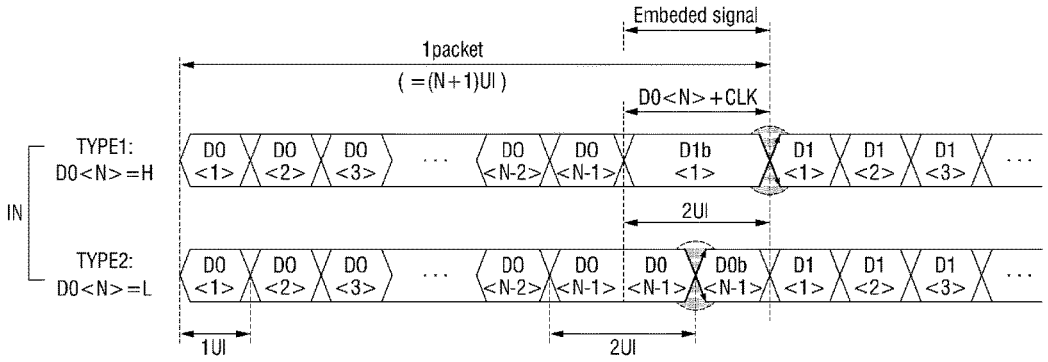
FIG. 4 is a diagram illustrating an embedded data packet in the display driving circuit according to an example embodiment of the present inventive concepts.
Figure 5:
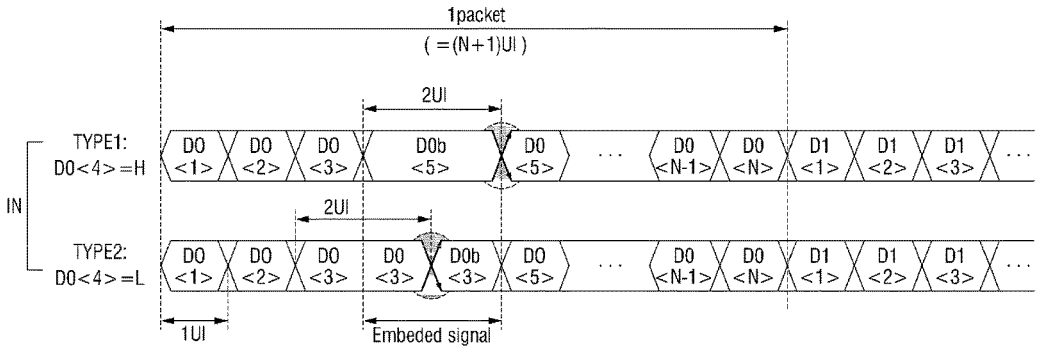
FIG. 5 is a diagram illustrating a data packet including an embedded in the display driving circuit according to another example embodiment of the present inventive concepts.

FIG. 3 is a block diagram of a signal controller of the display device according to an example embodiment of the present inventive concepts, FIG. 4 is a diagram illustrating an embedded data packet in the display driving circuit according to an example embodiment of the present inventive concepts. FIG. 5 is a diagram illustrating an embedded data packet in the display driving circuit according to another example embodiment of the present inventive concepts.

Referring to FIGS. 3 and 4, in the display device according to an example embodiment of the present inventive concepts, the signal controller 20 may include a first converter 21 and a second converter 22.

When a reference bit of the data signal has a first value, the first converter 21 may form a first type data packet including a 2-bit embedded signal, which does not include a transition. For example, when the reference bit is an Nth bit among N data bits and the reference bit has a value '1' (e.g., referring to a high value (H) in a digital logic signal), the 2-bit embedded signal may not have a transition. For example, the 2-bit embedded signal may have a transition value of a signal appearing right after the embedded signal. Thus, when the signal appearing right after the embedded signal has a value '1', the embedded signal may have a value '0' (e.g., referring to a low value (L) in a digital logic signal). That is to say, two bits of the embedded signal of the first type data packet may As the result, a transition may be generated between the embedded signal and the signal appearing right after the embedded signal. A run length of two times of the unit interval UI, i.e., 2 UI, may be maintained ahead of the transition. The first converter 21 maintains the run length by 2 UI for the purpose of reducing jitters of the transition considering inter symbol interference (ISI) in a high-speed operation of the display driving circuit. The transition appearing right after the embedded signal may be used to extract a clock signal. As will later be described in detail, the clock signal may be delayed by 0.5 UI from the transition appearing right after the embedded signal. However, the present inventive concepts are not limited thereto.

The reference bit of the first type data packet may be any one of the N-bit data signals. For example, the reference bit may be an MSB of the data signal. However, the present inventive concepts are not limited thereto.

When the first type data packet includes an N-bit data signal, the first type data packet may consist of (N+1) bits. For example, the (N+1)-bit first type data packet may include (N−1)-bit data bits and 2-bit embedded signals. The embedded signals may include reference bit information and clock signal information. Therefore, after receiving the first type data packet, the display driving circuit 1 (including, for example, the display driving ICs DDI1 to DDI3) may extract N data bits and a clock signal from the first type data packet. Detailed explanation will be provided later.

The embedded signal may be positioned at the last place in the first type data packet. However, the present inventive concepts are not limited thereto. As will later be described with reference to FIG. 5, the 2-bit embedded signal may be positioned at the middle place of the first type data packet.

The second converter 22 may operate to correspond to the first converter 21. That is to say, when the reference bit of the data signal has a transition value of the first value, the second converter 22 may form a second type data packet including a 2-bit embedded signal, which includes a transition. For example, when the reference bit is an Nth bit among N data bits and the reference bit has a value '0', the 2-bit embedded signal may have a transition. Here, the 2-bit embedded signal may have a first bit and a second bit. The first bit may be the same with a signal appearing right ahead of the embedded signal and the second bit may be a transitioned signal of the first bit. Thus, when the signal appearing right ahead of the embedded signal has a value '1', the first bit of the embedded signal may have a value '1' and the second bit may have a value '0'. That is to say, two bits of the embedded signal in the second type data packet may have different values.

As the result, a transition may be generated between the embedded signal and the signal appearing right after the embedded signal and a run length of two times of the unit interval UI, i.e., 2 UI, may be maintained ahead of the transition. Like the first converter 21, the second converter 22 may maintain the run length by 2 UI for the purpose of minimizing jitters of the transition in a high-speed operation of the display driving circuit 1. The transition included in the embedded signal may be used to extract a clock signal. As will later be described in detail, the clock signal may be delayed by 1.5 UI from the transition included in the embedded signal. However, the present inventive concepts are not limited thereto.

The reference bit of the second type data packet may be any one of the N-bit data signals. For example, the reference bit may be a MSB of the data signal. However, the present inventive concepts are not limited thereto.

When the second type data packet includes an N-bit data signal, the second type data packet may consist of (N+1) bits. For example, the (N+1)-bit second type data packet may include (N−1)-bit data bits and 2-bit embedded signals. The embedded signals may include a piece of reference bit information and clock signal information. Therefore, after receiving the second type data packet, the display driving circuit 1 (including, for example, the display driver ICs DDI1 to DDI3) may extract N data bits and a clock signal from the second type data packet.

Referring to FIG. 5, the data packet may be of a first type or a second type in which the embedded signal is positioned at a middle place of the data packet.

A reference bit may be any one among data bits. In the following description, it is assumed that the reference bit is a fourth data bit.

When the reference bit has a value '1', the first type data packet may be formed. The first type data packet may include an embedded signal, which does not include a transition. That is to say, because the embedded signal has no transition, two bits included in the embedded signal may have the same value. The embedded signal may appear after the third data signal. A fifth data signal may appear right after the embedded signal. The embedded signal may have a transition value of the fifth data signal. For example, when the fifth data signal has a value '1', the embedded signal may have a value '0', a signal having the value '0' may be maintained for an interval of 2 bits, and a transition may be generated between the embedded signal and the fifth data signal. The transition may be used in extracting a clock signal.

When the reference bit has a value '0', the second type data packet may be formed. The second type data packet may include an embedded signal, which includes a transition. That is to say, because the embedded signal has a transition, two bits included in the embedded signal may have different values. The embedded signal may appear after the third data signal. The fifth data signal may appear right after the embedded signal. The embedded signal may have a first bit and a second bit. The first bit may be the same with a signal appearing right ahead of the embedded signal and the second bit may be a transition signal of the first bit. For example, when the third data signal has a value '1', the first bit of the embedded signal may have a value '1' and the second bit may have a value '0'.

That is to say, two bits of the embedded signal in the second type data packet may have different values.

As the result, the value '1' of the third data signal may be maintained for an interval of 2 bits and a transition may be generated between the first bit and the second bit included in the embedded signal. The transition may be used to extract the clock signal.

That is to say, if sampled values of the first bit and the second bit of the embedded signal are the same with each other, the reference bit is a first value (e.g., '1') and if sampled values of the first bit and the second bit of the embedded signal are different from each other, the reference bit may be a transitioned value of the first value (e.g., '0'). Thus, the clock signal may be extracted using a transition included in the embedded signal or a transition generated right after the embedded signal. Therefore, the 2-bit embedded signal may include a value of a reference bit and information on a clock signal.

As described above, a frequency concentration phenomenon, which may occur in a clock embedding signaling method in which a clock signal is included at the same position of a data packet for data transmission, may be suppressed by dividing data into a first type data packet and a second type data packet in data transmission. Accordingly, it is possible to reduce or prevent the EMI from being occurring due to energy concentration of an electronic device on a particular frequency and adversely affecting the operation of another electronic device.

Figure 6:
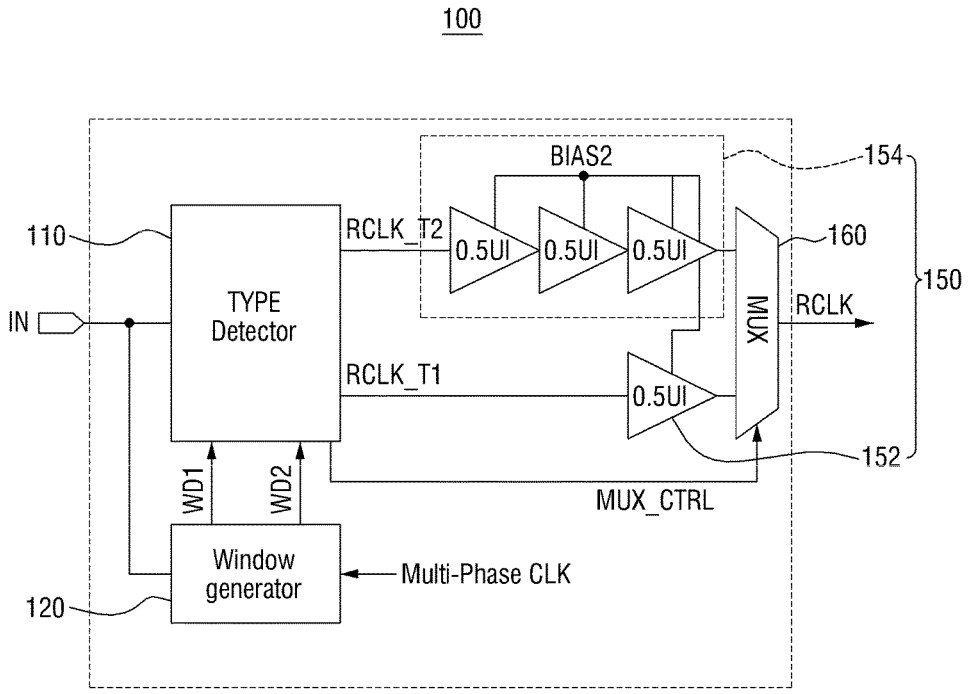
FIG. 6 is a block diagram of a clock recovery circuit of the display driving circuit according to an example embodiment of the present inventive concepts.
Figure 7:
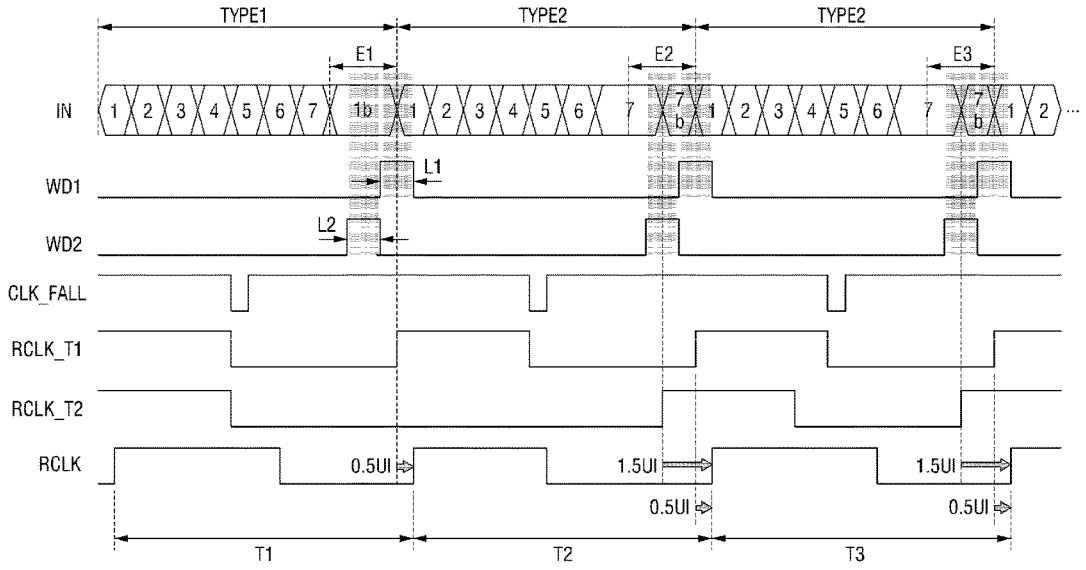
FIG. 7 is a timing diagram for explaining an operation of the clock recovery circuit of the display driving circuit according to an example embodiment of the present inventive concepts.

FIG. 6 is a block diagram of a clock recovery circuit of the display driving circuit according to an example embodiment of the present inventive concepts. FIG. 7 is a timing diagram for explaining an operation of the clock recovery circuit of the display driving circuit according to an example embodiment of the present inventive concepts.

For the sake of convenient explanation, the same content with the previous example embodiment will be omitted and the following description will focus on differences between the previous and present example embodiments.

Referring to FIG. 6, the clock recovery circuit 100 includes a type detector 110, a window generator 120, a buffer 150, and a multiplexer 160. The clock recovery circuit 100 may receive a data packet (IN) from the signal controller 20. An embedded signal may be positioned at the last place of a data packet.

The data packet may include a first type data packet having the embedded signal, which does not include a transition and a second type data packet having the embedded signal, which includes a transition. The embedded signal included in the first type data packet may have a transition value of a signal appearing right after the embedded signal. The embedded signal included in the second type data packet may include a first bit that is the same value as a signal appearing right ahead of the embedded signal and a second bit that is a transitioned signal of the first bit. The first bit may precede the second bit.

The type detector 110 may receive a data packet including a 2-bit embedded signal, in which a clock signal is embedded in a data signal and may output a first reference clock RCLK_T1 and a second reference clock RCLK_T2 different from each other according to the type of the data packet. For example, the type detector 110 may receive a first or second type data packet from the signal controller 20 and may output the first and second reference clocks RCLK_T1 or RCLK_T2 to the buffer 150. Further, the type detector 110 may receive first and second window references WD1 and WD2 different from each other from the window generator 120. The type detector 110 determines whether the received data packet is the first type data packet or the second type data packet using the first and second window references WD1 and WD2. Next, when the received data packet is the first type data packet, the type detector 110 may output the first reference clock RCLK_T1 to a first line. When the received data packet is the second type data packet, the type detector 110 may output the second reference clock RCLK_T2 to a second line.

The type detector 110 may distinguish the first type data packet and the second type data packet from each other according to a position of the transition included in the embedded signal or a transition appearing right after the embedded signal. For example, the type detector 110 may detect, using the first window reference WD1 received from the window generator 120, whether the transition appears after the embedded signal. The first window reference WD1 may be enabled to allow the transition appearing right after the embedded signal to be positioned at the middle place of the date packet. For example, the first window reference WD1 may be enabled for a time period L1 corresponding to the unit interval UI. Next, when the transition appears after the embedded signal, the type detector 110 may generate a first reference clock RCLK_T1, which has a rising edge at the same timing as the transition. When a falling clock CLK_FALL is generated after a lapse of a desired (or alternatively, predetermined) time, the first reference clock RCLK_T1 may have a falling edge. The falling clock CLK_FALL may be generated at the middle place of the data packet. However, the present inventive concepts are not limited thereto.

Likewise, the type detector 110 may detect whether the transition is included in the embedded signal using the second window reference WD2 received from the window generator 120. The second window reference WD2 may be enabled to allow the transition included in the embedded signal to be positioned at the middle place of the embedded signal. Like the first window reference WD1, the second window reference WD2 may be enabled for a time period L2 corresponding to the unit interval UI. Next, when the transition is generated in the embedded signal, the type detector 110 may generate a second reference clock RCLK_T2 having a rising edge at the same timing as the transition. When a falling clock CLK_FALL is generated after a lapse of a desired (or alternatively, predetermined) time, the second reference clock RCLK_T2 may have a falling edge. However, the present inventive concepts are not limited thereto.

The window generator 120 may receive multi-phase clocks and may provide the first and second window references WD1 and WD2 different from each other to the type detector 110. The first and second window references WD1 and WD2 are used to determine the type of the data packet. The window generator 120 may use the first or second type data packet to generate the first and second window references WD1 and WD2. The multi-phase clocks $\phi 1$ to $\phi N$ may include information concerning sampling timings of data packets.

As briefly described above, the first window reference WD1 may be enabled for a period of the first time L1 and the second window reference WD2 may be enabled for a period of the second time L2. The first window reference WD1 and the second window reference WD2 may not be enabled at the same time period. The first time L1 and the second time L2 may be equal to each other or there may be a unit interval UI between the first time L1 and the second time L2. However, the present inventive concepts are not limited thereto.

The first window reference WD1 may be enabled to allow the transition appearing right after the embedded signal included in the first type data packet to be positioned at the middle place of the embedded signal. Likewise, the second window reference WD2 may be enabled to allow the transition included in the embedded signal included in the second type data packet to be positioned at the middle place of the embedded signal. That is to say, the first window reference WD1 or the second window reference WD2 may be used to determine whether the transition is generated for the first time L1 or the second time L2.

The buffer 150 may delay the first reference clock RCLK_T1 output from the type detector 110 for a first interval and delay the second reference clock RCLK_T2 from the type detector 110 for a second interval different from the first interval.

For example, the buffer 150 may include a first buffer 152 and a second buffer 154.

The first buffer 152 may include a delay buffer delaying a signal by half the unit interval UI, i.e., 0.5 UI. The first buffer 152 may delay the first reference clock RCLK_T1 output from the type detector 110 for the first interval. The first interval may correspond to half the unit interval UI. Accordingly, the first reference clock RCLK_T1 output from the type detector 110 may be delayed to have a rising edge generated at the middle place of the first bit of the data packet.

The second buffer 154 may include, for example, three delay buffers. The second buffer 154 may delay the second reference clock RCLK_T2 output from the type detector 110 for the second interval. The three second buffers 154 may delay the second reference clock RCLK_T2 output from the type detector 110 for the second interval. The second interval may be greater than the first interval by the unit interval UI. For example, the second interval may be the unit interval UI greater than the first interval. That is to say, the second interval may be 1.5 times of the UI. The second reference clock RCLK_T2 output from the type detector 110 may be delayed to have a rising edge generated at the middle place of the first bit of the data packet.

The multiplexer 160 may multiplex the delayed first reference clock RCLK_T1 and the delayed second reference clock RCLK_T2 in response to a multiplexer control signal MUX_CTRL, and then output a multiplexed reference clock RCLK. That is to say, the multiplexed reference clock RCLK may be formed using the first reference clock RCLK_T1 delayed by 0.5 UI and the second reference clock RCLK_T2 delayed by 1.5 UI. The multiplexed reference clock RCLK may have a rising edge occurring at the middle place of the first bit of the data packet. Time periods T1 to T3 of the multiplexed reference clock RCLK may be equal to a length of the data packet. A falling edge of the multiplexed reference clock RCLK may occur at the middle place of each of the time periods, irrespective of whether the data packet is of the first reference clock RCLK_T1 or of the second reference clock RCLK_T2. However, the present inventive concepts are not limited thereto.

Referring to FIG. 7, a first data packet among data packets (IN) input to the type detector 110 includes a first type data packet (TYPE1), which consists of 9 bits and has an embedded signal positioned at places of the last 2 bits. An embedded signal E1 of the first data packet may be maintained for a 2-bit interval and a transition is generated right after the embedded signal comes to an end while a first window reference WD1 is enabled. Next, the type detector 110 may generate a rising edge at the first reference clock RCLK_T1. Next, the buffer 150 may delay the first reference clock RCLK_T1 by 0.5 UI, which may be reflected to the multiplexed reference clock RCLK to be output from the clock recovery circuit 100.

Following the first type data packet, a second type data packet is input and an embedded signal E2 has a transition. Therefore, because seventh and eighth bits of the second type data packet have the same value, constant values may be maintained for a 2-bit interval. Next, a ninth bit of the second type data packet may have a transitioned value of the seventh bit. Therefore, the embedded signal E2 may have a transition. The transition may be generated within a period in which the second window reference WD2 is enabled. Next, the type detector 110 may generate a rising edge at the second reference clock RCLK_T2. Then, the buffer 150 may delay the second reference clock RCLK_T2 by 1.5 UI, which may be reflected to the multiplexed reference clock RCLK to be output from the clock recovery circuit 100. However, the present inventive concepts are not limited thereto.

Accordingly, the rising edge of the multiplexed reference clock RCLK may be generated at the middle place of a bit included in the data packet, instead of at a place between two adjacent bits of the data packet. That is to say, the multiplexed reference clock RCLK may be delayed by multiple times of 0.5 UI.

Figure 8:
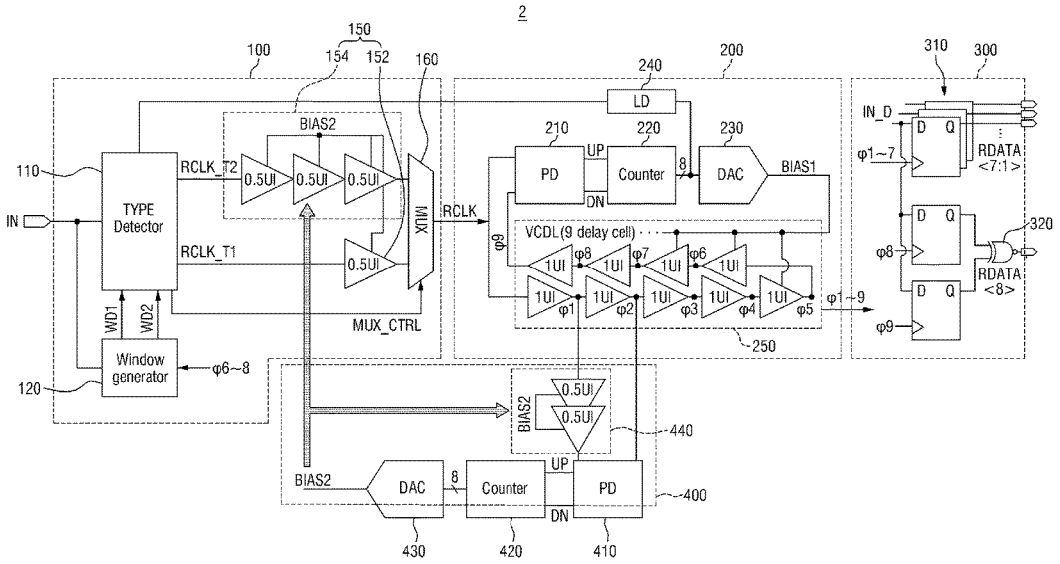
FIG. 8 is a block diagram of a display driving circuit according to another example embodiment of the present inventive concepts.
Figure 9:
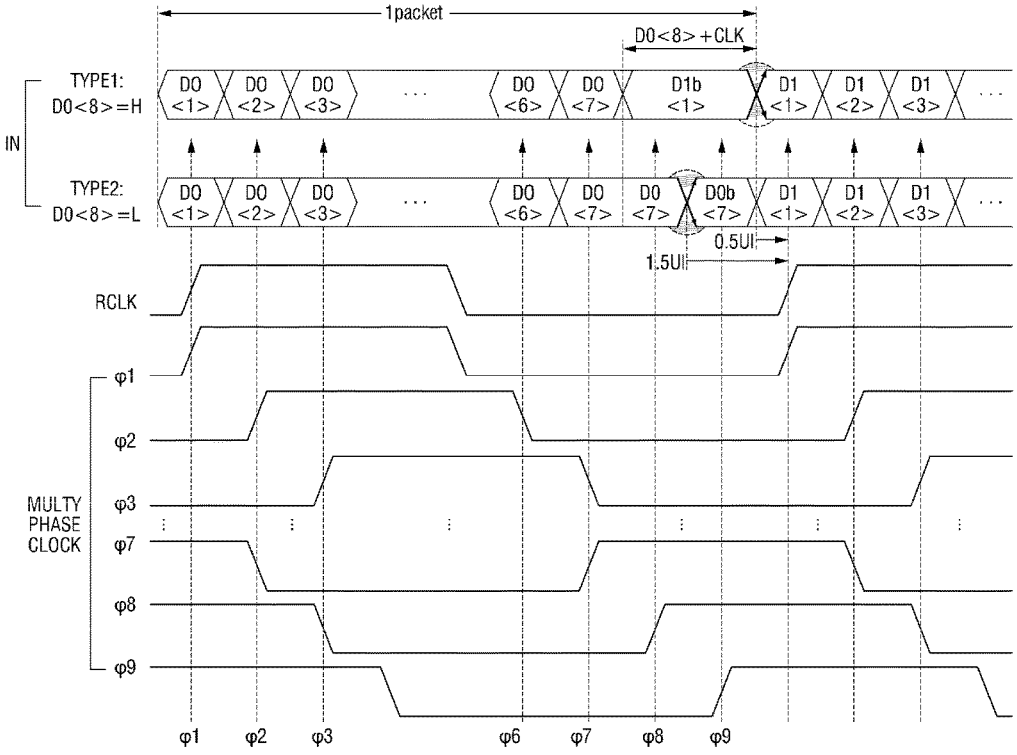
FIG. 9 is a timing diagram for explaining an operation of the display driving circuit according to another example embodiment of the present inventive concepts.

FIG. 8 is a block diagram of a display driving circuit according to another example embodiment of the present inventive concepts and FIG. 9 is a timing diagram for explaining an operation of the display driving circuit according to another example embodiment of the present inventive concepts. For the sake of convenient explanation, the same contents with the previous embodiment will be omitted and the following description will focus on differences between the previous and present example embodiments.

Referring to FIGS. 8 and 9, a display driving circuit 2 according to another example embodiment of the present inventive concepts may include a clock recovery 100, a delay locked loop 200, a sampler 300, and a bias generator 400.

In the display driving circuit 2 according to this example embodiment of the present inventive concepts, the clock recovery circuit 100 may operate in substantially the same manner with the clock recovery circuit 100 according to the previous example embodiment of the present inventive concepts shown in FIGS. 6 and 7. In the following description, it is assumed that one data packet includes 9 bits.

The delay locked loop 200 may receive the multiplexed reference clock RCLK from the clock recovery circuit 100 and may generate multi-phase clocks $\phi 1$ to $\phi 9$.

The delay locked loop 200 may include a phase detector (PD) 210, a counter 220, a digital analog convertor (DAC) 230, a lock detector (LD) 240, and a voltage controlled delay line (VCDL).

The phase detector 210 may receive signals $\Phi 9$ delayed from the multiplexed reference clock RCLK by a number of bits included in one data packet and output from the VCDL. The phase detector 210 may detect a phase difference through phase comparison of the two input signals and may output an up signal (UP) or a down signal (DN). For example, if the multiplexed reference clock RCLK is faster than the signal $\phi 9$ output from the VCDL in phase, the phase detector 210 may generate an up signal (UP), and if the multiplexed reference clock RCLK is slower than the signal $\phi 9$ output from the VCDL in phase, the phase detector 210 may generate a down signal (DN). However, the present inventive concepts are not limited thereto.

When the up signal (UP) is input from the phase detector 210, the counter 220 and the digital analog converter 230 may increase a voltage of a first bias BIAS1. When the down signal (DN) is input from the phase detector 210, the counter 220 and the digital analog converter 230 may decrease a voltage of the first bias BIAS1. The first bias BIAS1 may be provided to a plurality of buffers 150 included in the VCDL.

The VCDL may include as many buffers 150 as the number of bits included in a data packet. For example, the data packet may include nine buffers 150. An output of each of the buffers 150 may be connected to an input of another buffer 150 and each of the buffers 150 may be controlled by the first bias BIAS1. Each of the buffers 150 may delay a signal by a unit interval UI. For example, when a multiplexed reference clock RCLK passes a buffer 150, a first phase clock $\phi 1$ may be generated, and when the multiplexed reference clock RCLK passes two buffers 150, a second phase clock $\phi 2$ may be generated. Therefore, the VCDL may generate as many multi-phase clocks $\phi 1$ to $\phi 9$ as the number of bits included in the data packet.

The multi-phase clocks $\phi 1$ to $\phi 9$ may be generated to be sequentially delayed by the unit interval UI corresponding to an interval of 1-bit on the basis of the reference clock RCLK.

The respective multi-phase clocks ϕ1 to ϕ9 may be generated to be delayed by the interval of 1-bit. The generated multi-phase clocks ϕ1 to ϕ9 may be used to sample data signals from the data packet. N multi-phase clocks ϕ1 to ϕ9 may be transferred to the sampler 300. Further, some of the multi-phase clocks ϕ1 to ϕ9 may be provided to the bias generator 400, which is configured to lock a bias to delay the signal by an integer multiple of half the unit interval UI. Further, some of the multi-phase clocks ϕ1 to ϕ9 may be transferred to the window generator 120 of the clock recovery circuit 100. For example, sixth to eighth phase clocks ϕ6 to ϕ8 may be transferred to the window generator 120. However, the present inventive concepts are not limited thereto.

The lock detector 240 may receive an input applied between the counter 220 and the digital analog converter 230 and may detect whether the multi-phase clocks ϕ1 to ϕ9 of the delay locked loop 200 are locked or not. The lock detector 240 may control the operation of the type detector 110 according to whether the multi-phase clocks ϕ1 to ϕ9 are locked or not. For example, when the multi-phase clocks ϕ1 to ϕ9 are not locked, the lock detector 240 may control the type detector 110 to not operate. The data packet input to the type detector 110 may be applied to the delay locked loop 200 through a first line. Next, when the multi-phase clocks ϕ1 to ϕ9 of the delay locked loop 200 are locked by repeated operations, the lock detector 240 sends a control signal to allow the type detector 110 to normally operate. The type detector 110 may output the first or second reference clock RCLK_T1 or RCLK_T2 according to the type of the data packet when the operation signal of the lock detector 240 is input. However, the present inventive concepts are not limited thereto.

The sampler 300 may extract a plurality of data signals from the data packet using the multi-phase clocks ϕ1 to ϕ9. The sampler 300 may include a plurality of flip flops 310. For example, the sampler 300 may include as many flip flops as the number of bits included in the data packet. The respective phase clocks ϕ1 to ϕ9 generated from the delay locked loop 200 may be input to the respective flip flops 310, respectively. The respective flip flops 310 may receive a delayed signal IN_D of the data packet, which is obtained based on a delay occurring while passing through the delay locked loop 200. Each of the flip flops 310 may sample, using each of the received multi-phase signals ϕ1 to ϕ9, the data packet input at a timing of a rising edge of each of the multi-phase clocks ϕ1 to ϕ9 may be sampled. In such a manner, one flip flop 310 may sample a value for one bit of the data packet. Referring to FIG. 9, the flip flops 310 may include nine flip flops and extract nine signals using nine multi-phase clocks ϕ1 to ϕ9. Among the nine signals, first to seventh signals may be sampled values of the data signals RDATA <7:1> and eighth and ninth signals may be sampled values of embedded signals.

The sampler 300 may include a logic extracting a 1-bit data signal from the embedded signal included in the data packet. For example, the sampler 300 may include an exclusive OR gate 320 receiving a 2-bit embedded signal as an input. That is to say, the exclusive OR gate 320 may receive signals of eighth and ninth flip flops 318 and 319. Next, when the signals of eighth and ninth flip flops 318 and 319 have the same value, the exclusive OR gate 320 may output a value '1' and when the signals of eighth and ninth flip flops 318 and 319 have different values, the exclusive OR gate 320 may output a value '0'. The value output from the exclusive OR gate 320 may be a value of the reference bit. That is to say, the exclusive OR gate 320 may extract the value of the reference bit corresponding to the eighth data signal RDATA <8> from the embedded signal. However, the present inventive concepts are not limited thereto. A logic other than the exclusive OR gate 320 may also be used. The sampler 300 may extract the 1-bit data signal from the embedded signal using Nth and (N+1)th signals of the multi-phase clocks ϕ1 to ϕ9 and may output N-bit data signals including the extracted data signal.

The display driving circuit 2 may further include a bias generator 400.

The bias generator 400 may include a phase detector (PD) 410, a counter 420, a digital analog converter (DAC) 430 and a buffer 440. A phase detector (PD) 410, a counter 420 and a digital analog converter 430 of the bias generator 400 may operate in substantially the same manner with the phase detector 210, the counter 220 and the digital analog converter 230 of the delay locked loop 200. Thus, the following description will focus on differences between the delay locked loop 200 and the bias generator 400.

The phase detector 410 may receive an input signal (e.g., ϕ1) and an output signal (e.g., ϕ2) of a particular buffer among buffers of the VCDL of the delayed locked loop 200. However, the input signal (e.g., ϕ1) may first pass the buffer 440 and then be applied to the phase detector 410.

The buffer 440 may include two delay buffers each delaying a signal by half the unit interval UI, i.e., 0.5 times of the UI. Like the buffer of the clock recovery circuit 100, the buffer 440 in the delay locked loop 200 may be controlled by a second bias BIAS2. The bias generator 400 may lock the bias such that each of the buffer included in the clock recovery 100 delays the signal by 0.5 UI.

Further, the phase detector 410 may output an up signal (UP) or a down signal (DN) based on a phase difference between the input signal (e.g., ϕ1) delayed by the buffer 440 and the output signal (e.g., ϕ2). However, the present inventive concepts are not limited thereto. When the up signal (UP) is input from the phase detector 410, the counter 420 and the digital analog converter 430 may increase a voltage of the second bias BIAS2. When the down signal (DN) is input from the phase detector 410, the counter 420 and the digital analog converter 430 may decrease a voltage of the second bias BIAS2. The second bias BIAS2 may be provided to a first buffer 152 and a second buffer 154 of the clock recovery circuit 100 and the buffer 440 of the bias generator 400. Accordingly, the delay buffers included in the clock recovery circuit 100 and the bias generator 400 may delay the signals accurately by half the unit interval UI.

With the configuration of the display driving circuit 2, the number of delay buffers of the delay locked loop 200 may be minimized, thereby achieving low power consumption and an area reducing effect. Further, a high-speed operation of the display driving circuit can be advantageously achieved by reducing the number of delay buffers.

Figure 10:
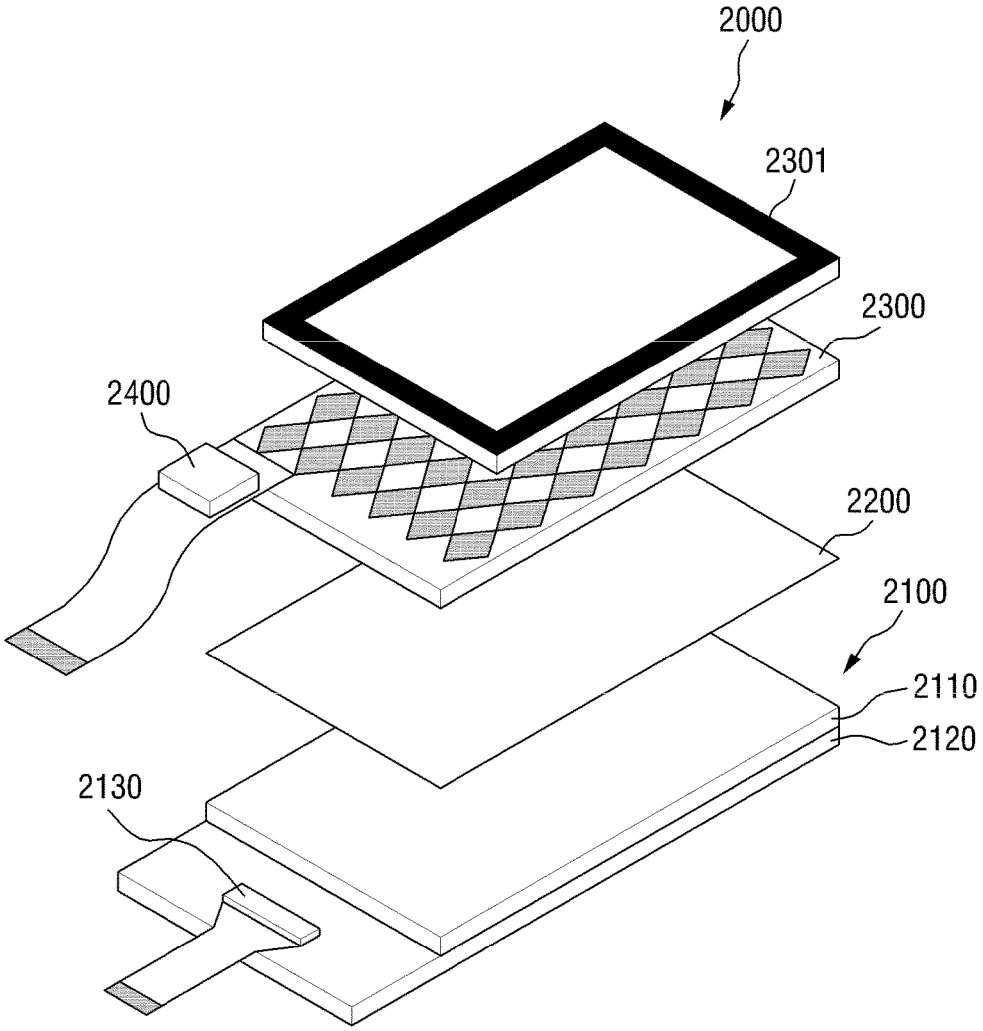
FIG. 10 is a diagram illustrating a display module according to example embodiments of the present inventive concepts.

FIG. 10 is a diagram illustrating a display module according to an example embodiment of the present inventive concepts.

Referring to FIG. 10, a display module 2000 may include a display device 2100, a polarizing plate 2200 and a window glass 2301. The display device 2100 includes a display panel 2110, a printed circuit board 2120 and a display driving chip 2130.

The window glass 2301 may be fabricated using a material such as acryl or tempered glass and may protect the display module 2000 from abrasions due to external impacts or repeated touches. The polarizing plate 2200 may be provided to enhance optical properties of the display panel 2110. The display panel 2110 may be formed by patterning a transparent electrode on the printed circuit board 2120. The display panel 2110 includes a plurality of pixel cells for displaying frames. In an example embodiment, the display panel 2110 may be an organic light emitting diode (OLED) panel. Each pixel cell may include an OLED emitting light according to flow of current. However, the present inventive concepts are not limited thereto. The display panel 2110 may include a variety of kinds of display devices. For example, the display panel 2110 may be one of liquid crystal display (LCD), an electrochromic display (ECD), a digital minor device (DMD), an actuated mirror device (AMD), a grating light value (GLV), a plasma display panel (PDP), an electro luminescent display (ELD), a light emitting diode display (LED), and a vacuum fluorescent display (VFD).

The display driving chip 2130 may include the above-described display driving circuit. In the present example embodiment, one single chip is illustrated. However, the present inventive concepts are not limited thereto. A plurality of display driving chips may be mounted. Further, the plurality of display driving chips may be mounted on a glass printed circuit board 2120, for example, in a chip on glass (COG) type. The display driving chip 2130 may be mounted in different types, which include, for example, a chip on film (COF), or a chip on board (COB).

The display module 2000 may further include a touch panel 2300 and a touch controller 2400. The touch panel 2300 may be formed by patterning a transparent electrode made of, for example, an indium tin oxide (ITO) on, for example, a glass substrate or a polyethylene terephthalate (PET) film. The touch controller 2400 may sense a touch generated on the touch panel 2300 and may calculate coordinates of the touch and transmit the calculated coordinates to a host (not shown). The touch controller 2400 and the display driving chip 2130 may be integrated into a single semiconductor chip.

Figure 11:
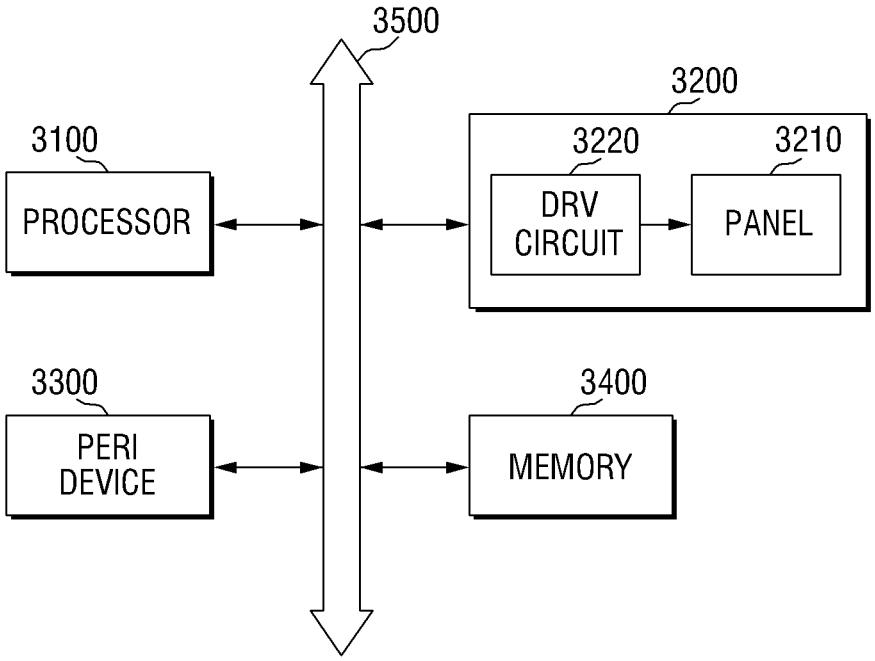
FIG. 11 is a diagram illustrating a display system according to example embodiments of the present inventive concepts.

FIG. 11 is a diagram illustrating a display system according to an example embodiment of the present inventive concepts.

Referring to FIG. 11, a display system 3000 may include a processor 3100, a display device 3200, a peripheral device 3300 and a memory 3400, which are electrically connected to a system bus 3500.

The processor 3100 may control data input/output to/from the peripheral device 3300, the memory 3400 and/or the display device 3200, and may perform image processing of image data communicated between the devices.

The display device 3200 may include a panel 3210 and a driving circuit 3220. The display device 3200 may store image data applied through the system bus 3500 in a frame memory included in the driving circuit 3220, and/or display the stored image data on the panel 3210. The display device 3200 may be the same with the display device shown in FIG. 1. Therefore, the display device 3200 may operate asynchronously with the processor 3100, thereby reducing the system burden of the processor 3100.

The peripheral device 3300 may be a device that converts a motion image or a still image into an electric signal. For example, the peripheral device 3300 may include a camera, a scanner, or a webcam. The image data acquired through the peripheral device 3300 may be stored in the memory 3400 or may be displayed on a panel of the display device 3200 in real time.

The memory 3400 may include a volatile memory, for example, a DRAM, and/or a nonvolatile memory, such as a flash memory. The memory 3400 may include, for example, DRAM, PRAM, MRAM, ReRAM, FRAM, NOR flash memory, NAND flash memory, and a fusion flash memory (e.g., a combined memory of a SRAM buffer, a NAND flash memory and a NOR interface logic). The memory 3400 may store the image data acquired from the peripheral device 3300 or the image signal processed by the processor 3100.

The display system 3000 according to an example embodiment of the present inventive concepts may be incorporated into a mobile electronic device such as a smart phone. However, the present inventive concepts are not limited thereto. The display system 3000 may be incorporated into a variety of electronic devices capable of displaying images.

Figure 12:
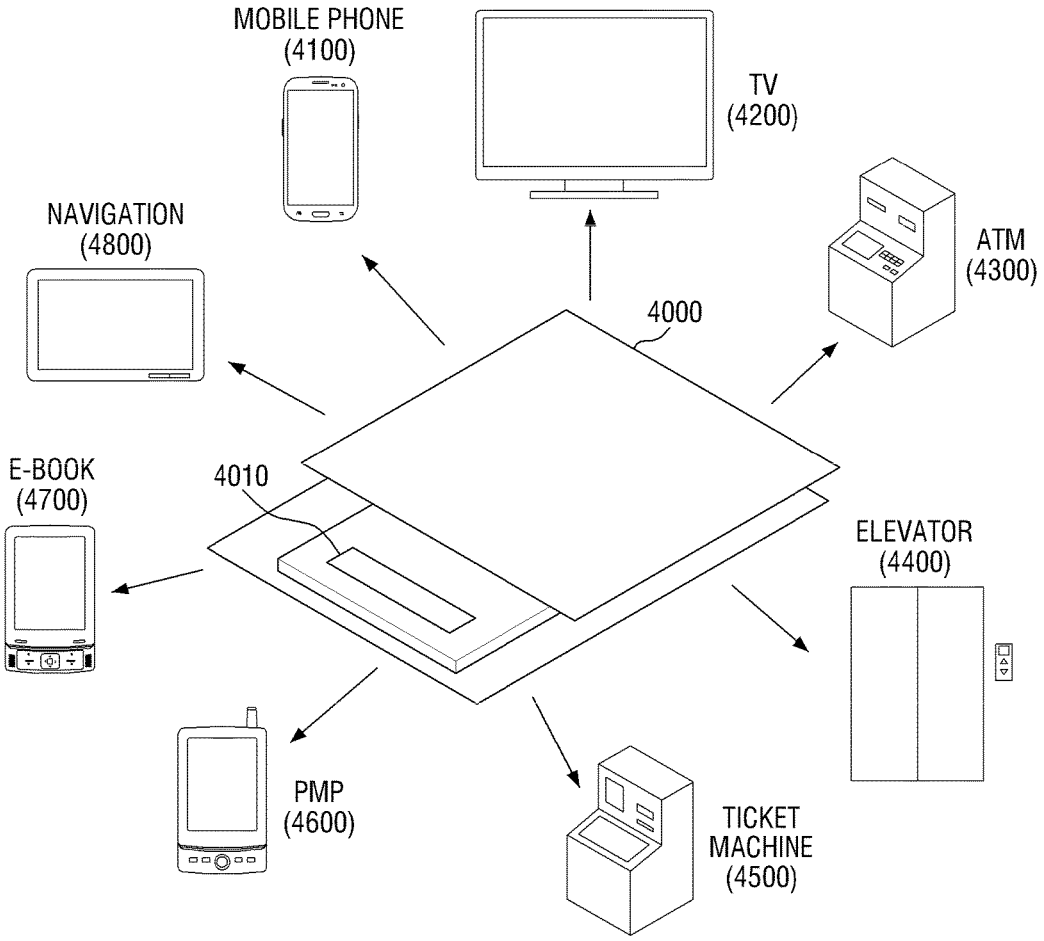
FIG. 12 is a diagram illustrating application examples of various electronic products employing a display device according to one of example embodiments of the present inventive concept mounted thereon.

FIG. 12 is a diagram illustrating application examples of various electronic products employing a display device according to an example embodiment of the present inventive concepts.

A display device 4000 according to various example embodiments of the present inventive concepts may be employed to various electronic products. For example, the display device 4000 may be used in, for example, a mobile phone 4100, a TV 4200, an automated teller machine (ATM) 4300 for automatically conducting a banking transaction for, for example, cash deposit or withdrawal, an elevator 4400, a ticket machine 4500 used in, for example, a subway station, a portable media player (PMP) 4600, an e-book 4700, a navigation device 4800.

The display device 4000 according to some example embodiments of the present inventive concepts may operate asynchronously with the system processor. Therefore, the processor may operate at a relatively high speed with relatively low power consumption by reducing the driving burden of the processor, thereby providing electronic products having improved functionality.

While the present inventive concepts has been particularly shown and described with reference to some example embodiments thereof, it will be understood by those of ordinary skill in the art that various changes in form and details may be made therein without departing from the spirit and scope of the present inventive concepts as defined by the following claims. It is therefore desired that the present example embodiments be considered in all respects as illustrative and not restrictive, reference being made to the appended claims rather than the foregoing description to indicate the scope of the inventive concepts.

What is claimed is:

1. A display driving circuit comprising:

a clock recovery circuit configured to receive a data packet including a 2-bit embedded signal, in which a clock signal is embedded in a data signal, and generate a multiplexed reference clock having a rising edge at a middle place of a first bit of the data packet;

a delay locked loop configured to receive the multiplexed reference clock and generate multi-phase clocks sequentially delayed by a unit interval, the unit interval corresponding to an interval of one bit; and a sampler configured to extract a plurality of data signals from the data packet using the multi-phase clocks, the sampler including a logic configured to extract a 1-bit data signal from the 2-bit embedded signal, wherein the rising edge of the multiplexed reference clock is not generated at a place between two adjacent bits of the data packet.

2. The display driving circuit of claim 1, wherein the clock recovery circuit comprises:

a type detector configured to output one of a first reference clock and a second reference clock different from the first reference clock according to a type of the data packet;

a first buffer circuit configured to delay the first reference clock by a first interval;

a second buffer circuit configured to delay the second reference clock by a second interval different from the first interval; and a multiplexer connected to the first and second buffer circuits and configured to multiplex the delayed first and second reference clocks to generate the multiplexed reference clock.

3. The display driving circuit of claim 2, further comprising:

a window generator configured to receive at least some of the multi-phase clocks and the data packet and provide a window reference used to determine a type of the data packet provided to the type detector.

4. The display driving circuit of claim 2, wherein the first interval is half the unit interval and the second interval is greater than the first interval by the unit interval.

5. The display driving circuit of claim 2, further comprising:

a bias generator configured to receive some of the multi-phase clocks and provide a bias to the first buffer circuit and the second buffer circuit.

6. The display driving circuit of claim 5, wherein the first buffer circuit is configured to delay the first reference clock by half the unit interval, the second buffer circuit is configured to delay the second reference clock by 1.5 times the unit interval, and the bias generator is configured to lock the bias such that the first and second buffer circuits are activated to delay the multiplexed reference clock by an integer multiple of half the unit interval.

7. The display driving circuit of claim 2, wherein the delay locked loop includes a lock detector, the lock detector configured to detect whether the multi-phase clocks are locked or not, and when an operation signal of the lock detector is input, the type detector is configured to output one of the first reference clock and the second reference clock according to the type of the data packet.

8. The display driving circuit of claim 1, wherein the data packet includes a first type data packet having the 2-bit embedded signal, which does not include a transition, and a transition value of the 2-bit embedded signal appearing right after the 2-bit embedded signal, and a second type data packet having the 2-bit embedded signal, which includes a transition.

9. A display driving circuit comprising:

a clock recovery circuit configured to receive a data packet including an embedded signal and generate a multiplexed reference clock having a rising edge at a middle place of one bit of the data packet, the data packet including a reference bit, the reference bit having a value depending on a type of the data packet;

a delay locked loop configured to receive the multiplexed reference clock and generate multi-phase clocks sequentially delayed by a unit interval, the unit interval corresponding to an interval of one bit; and a sampler configured to extract a plurality of data signals including an 1-bit data signal using the multi-phase clocks, the 1-bit data signal having a value of the reference bit, wherein the rising edge of the multiplexed reference clock is not generated at a place between two adjacent bits of the data packet.

10. The display driving circuit of claim 9, wherein when the data packet consists of (N+1) bits while including an N-bit data signal, a delay locked loop is configured to generate the multi-phase clocks of (N+1) signals and the sampler is configured to extract the 1-bit data signal using Nth and (N+1)th signals of the multi-phase clocks and output a plurality of data signals of N bit.

11. The display driving circuit of claim 9, wherein the clock recovery circuit includes a type detector configured to output one of a first reference clock and a second reference clock according to the type of the data packet, the first reference clock being different from the second reference clock;

a first buffer circuit configured to delay the first reference clock by a first interval;

a second buffer circuit configured to delay the second reference clock by a second interval different from the first interval; and a multiplexer connected to the first and second buffer circuits and configured to multiplex the delayed first and second reference clocks to generate the multiplexed reference clock.

12. The display driving circuit of claim 11, further comprising:

a bias generator configured to receive some of the multi-phase clocks and provide a bias to the first and second buffer circuits.

13. The display driving circuit of claim 11, wherein the delay locked loop is further configured to generate a lock detector signal and the type detector is further configured to output one of the first reference clock and the second reference clock according to the type of the data packet in response to the lock detector signal.

14. The display driving circuit of claim 1, further comprising:

a bias generator configured to receive some of the multi-phase clocks and provide a bias to the clock recovery circuit to adjust delay of the multiplexed reference clock by 0.5 times of an interval of one bit.

15. The display driving circuit of claim 9, further comprising:

a bias generator configured to receive some of the multi-phase clocks and provide a bias to the clock recovery circuit to adjust delay of the multiplexed reference clock by 0.5 times of an interval of one bit.

* * * * *